US008109726B2

(12) United States Patent
Liang

(10) Patent No.: US 8,109,726 B2
(45) Date of Patent: Feb. 7, 2012

(54) TURBINE BLADE WITH MICRO CHANNEL COOLING SYSTEM

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 479 days.

(21) Appl. No.: 12/355,887

(22) Filed: Jan. 19, 2009

(65) Prior Publication Data

US 2010/0183427 A1 Jul. 22, 2010

(51) Int. Cl.
*F01D 5/08* (2006.01)
*F01D 5/20* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 5,356,265 | A * | 10/1994 | Kercher | 416/97 R |
| 5,813,836 | A | 9/1998 | Starkweather | |
| 5,931,638 | A * | 8/1999 | Krause et al. | 416/97 R |
| 6,514,042 | B2 * | 2/2003 | Kvasnak et al. | 416/97 R |
| 7,775,468 | B2 * | 8/2010 | Bednarski et al. | 241/188.1 |
| 2002/0141869 | A1 * | 10/2002 | Lee et al. | 416/97 R |

* cited by examiner

*Primary Examiner* — David Zarneke

(57) ABSTRACT

A cooling system for a turbine airfoil of a turbine engine has a multi-pass serpentine flow circuit providing a flow path from a forward cooling flow entry at the root and exhausting towards the trailing edge through a series of chord wise micro channels extending from the rearward pass of the multi-pass serpentine circuit to pressure side bleed slots, each having a forward pressure side lip and opening onto the pressure side adjacent the trailing edge. The micro channels can be formed by a series of spaced fins stacked span wise and extending between the outer wall on the pressure side and the outer wall on the suction side and extending chord wise from the rearward pass to the trailing edge. At least two trip strips can extend from sides of the fins into the micro channels and be staggered relative to trip strips extending into the micro channel from an adjacent fin, whereby turbulent flow levels in the micro channels are increased.

12 Claims, 3 Drawing Sheets

TURBINE BLADE WITH MICRO CHANNEL COOLING SYSTEM

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. Some blades utilize a 5-pass serpentine arrangement in which cooling flows are routed span wise and distributed to forward, mid-chord and trailing edge sections of the blade.

The advancement of thermal barrier coating (TBC) technology has impacted the traditional cooling systems for turbine blades. As more industrial turbine blades are applied with thicker and lower conductivity TBC, the cooling flow demand for the TBC covered blade is reduced. As result, there is insufficient cooling to split the total cooling flow into two or three flow circuits and utilize a forward flowing serpentine cooling system. Cooling flow for the leading edge and trailing edge has to be combined with a mid-chord flow circuit to form a single 5-pass flow circuit. However, for a forward 5-pass flow circuit with total blade cooling flow, back flow margin (BFM) can become a design issue.

In a typical 5-pass aft flowing serpentine cooling design, the leading edge if cooled with backside impingement cooling together with leading edge showerhead film cooling. Cooling air is fed by the first up pass of the 5-pass serpentine flow channel. The main body is cooling by the serpentine flow channel with built in trip strips on the internal walls for the augmentation of internal heat transfer performance. The trailing edge is typically cooled with a double impingement cooling system in conjunction with pressure side bleed cooling. The blade tip is often cooled by bleed off from the serpentine turns at the tip end.

However, with the lower cooling flows utilized in more advanced TBC covered blades, the ability to use the impingement cooling mechanism with a pressure side bleed is compromised. Thus, there is a need for an effective cooling system for a low cooling flow environment in a hollow airfoil, such as a TBC enhanced blade.

SUMMARY OF THE INVENTION

Aspects of the invention relate to a turbine airfoil cooling system for a turbine airfoil used in turbine engines. In particular, the turbine airfoil cooling system may include one or more internal cavities positioned between outer walls of a generally elongated, hollow airfoil of the turbine airfoil. The cavity can form a multi-pass—preferably 5-pass—serpentine flow circuit with each pass extending span wise and connecting chord wise at a turn with an adjacent pass and providing a flow path from a forward cooling flow entry at the root and exhausting towards the trailing edge. The cooling flow passes through a series of chord wise micro channels extending from the rearward pass of the multi-pass serpentine circuit to pressure side bleed slots. Each of the pressure side bleed slots can have a forward pressure side lip and open onto the pressure side adjacent the trailing edge.

The micro channels can be formed by a series of spaced fins stacked span wise and extending between the outer wall on the pressure side and the outer wall on the suction side and extending chord wise from the rearward pass to the trailing edge. Multiple trip strips can extending from sides of the fins into the micro channels, whereby turbulent flow levels in the micro channels are increased. A set of at least two trip strips can extend from either side of each of the fins into the micro channels. In one arrangement, each set of at least two trip strips extending into each of the micro channels can be staggered relative an opposing set of at least two trip strips extending into the same micro channel from an adjacent fin.

The span wise height of each micro channel is approximately two times the span wise thickness of each fin. The span wise thickness of each fin is in a range of 0.005 inches to 0.03 inches. The span wise height of each trip strip span is between 0.005 inches to 0.01 inches. The outer wall thickness at the pressure side lip is in the range of 0.005 inches to 0.03 inches, and a diameter of the airfoil suction side trailing edge corner is in the range of 0.02 inches to 0.05 inches.

The micro channel design can be combined with other cooling features. For example, multiple leading edge showerhead film cooling holes can extend from a forward pass of the multi-pass serpentine flow circuit to the leading edge for supplying cooling air to the leading edge. Also, tip bleed holes can be provided for supplying cooling air to the blade tip from the multi-pass serpentine flow circuit.

The use of one or more of these features can increase the effectiveness of a multi-pass serpentine cooling circuit in a turbine blade having a reduced cooling flow, such as those coated with a TBC.

One advantage of the features according to aspects of the invention when used in a 5-pass serpentine cooling flow circuit is the elimination of cross over holes between the passes, thus improving blade casting yield during manufacture.

Another advantage is that the series of micro channels with turbulators can generate a much larger area ratio between internal convective surface to external hot gas side surface. This system can achiever a much higher overall blade trailing edge cooling efficiency than a double impingement cooling concept used in the traditional airfoil trailing edge cooling design.

Yet another advantage arises as the airfoil trailing edge tapers off toward the trailing edge and the cooling efficiency for the chord wise fin like becomes more effective. This suggests a better cooling for the airfoil tip corner, especially the suction side trailing edge corner which is normally is the life limiting location for the airfoil in a high temperature turbine application.

The multiple chord wise fins according to aspects of the invention increase the airfoil trailing edge stiffness. This stiffness allows a thinner wall to be used for the airfoil trailing edge. A thin wall design reduces the conduction path, thus yielding a better cooling and lower metal temperature. A thinner pressure wall also produce a smaller pressure side lip thickness, which reduces the share mixing between the cooling air and the hot gas stream, thus allowing the ejection cooling air to retain at high cooling level longer. This design translates into a better cooling for the pressure side slots.

A thinner airfoil trailing edge diameter or suction side wall also allows the cooling air ejected from the micro channel to be more in line with the main stream, thus minimizing the aerodynamic mixing losses.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF EMBODIMENTS OF THE INVENTION

Figure 1:
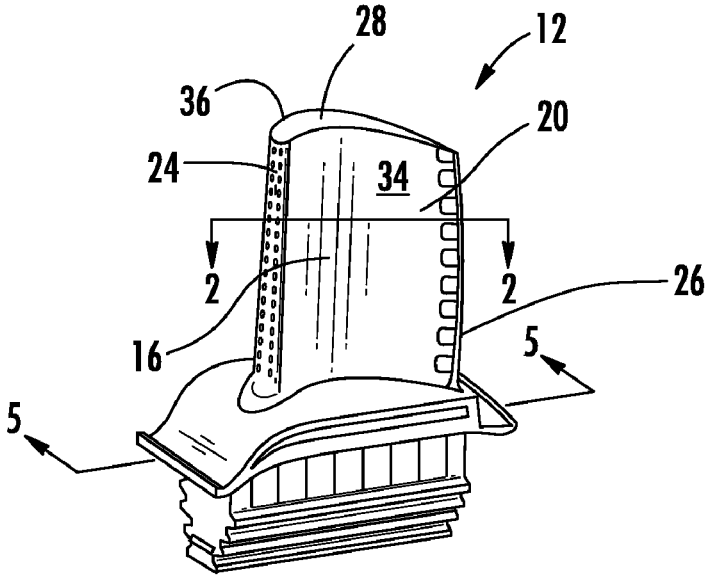
FIG. 1 is a perspective view of an embodiment of a turbine airfoil according to aspects of the invention.
Figure 2:
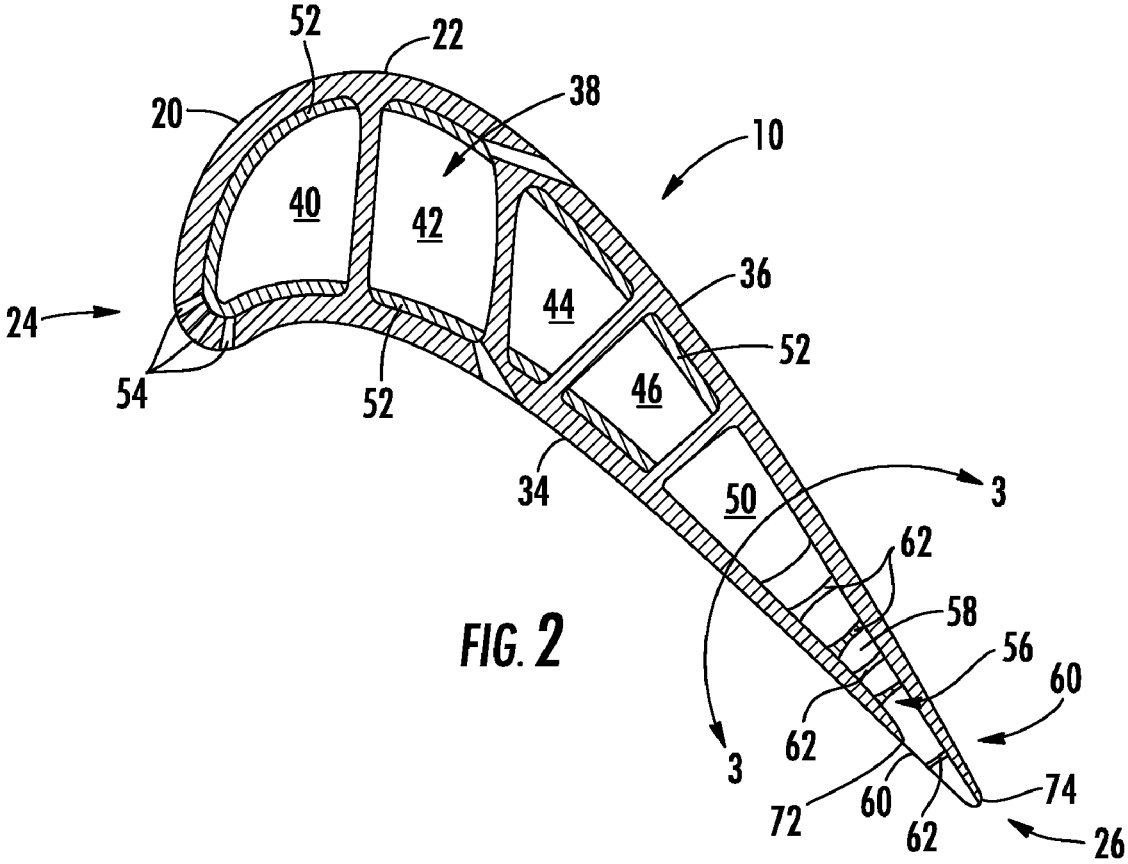
FIG. 2 is a cross-sectional view of the turbine airfoil shown in FIG. 1 taken along line 2-2, showing a cooling system according to aspects of the invention.
Figure 3:
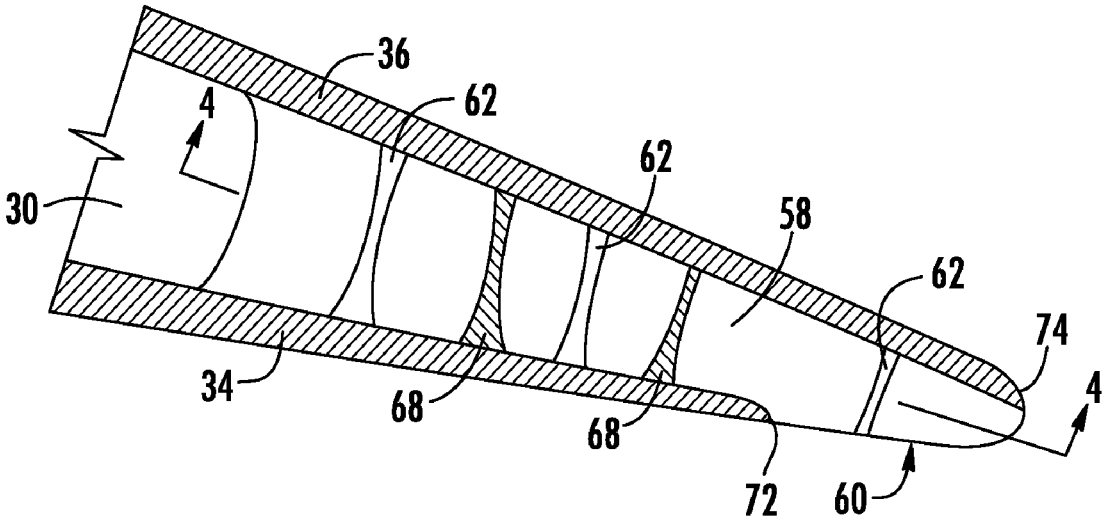
FIG. 3 is a detailed cross-sectional view of the trailing edge cooling system shown in FIG. 2 along line 3-3.

As shown in FIGS. 1-5, aspects of the invention is directed to a turbine airfoil cooling system 10 for a turbine airfoil 12 used in turbine engines. The airfoil 12 can include a generally elongated, hollow airfoil body 20 formed by an outer wall 22 extending chord wise from a forward leading edge 24 to a rearward trailing edge 26, a tip section 28 at a first span wise end, a root 30 coupled to the airfoil 20 at an end generally opposite the first tip end 28 span wise for supporting the airfoil 20 and for coupling the airfoil 20 to a disc (not shown), and a cooling system 10 formed from at least one cavity 32 in the elongated, hollow airfoil 20 positioned in internal aspects of the generally elongated, hollow airfoil 20. The outer wall 22 can include a concave pressure side wall 34 and a convex suction side wall 36 separated rearwardly by the trailing edge 26. The cooling system 10 has particular application to blades having a low cooling flow rate, such as blades coated with a thermal barrier coating (TBC).

The cooling system 10 can include a multi-pass, such as a 5-pass serpentine flow circuit 38. Cooling air is fed from the disk (not shown) through the forward most channel 40 of the 5-pass circuit 38. The flow continues rearward or aft through the span wise channels 42, 44, 46 until reaching the rearward pass 50. The airfoil main body 20 is cooled by the serpentine flow in the circuit 38. The channels 40, 42, 44, 46, 50 can include built-in trip strips 52 on the internal walls for the augmentation of internal heat transfer performance. The blade tip section 28 can be film cooled by bleed off cooling air from the serpentine turns near the tip section 28.

Figure 5:
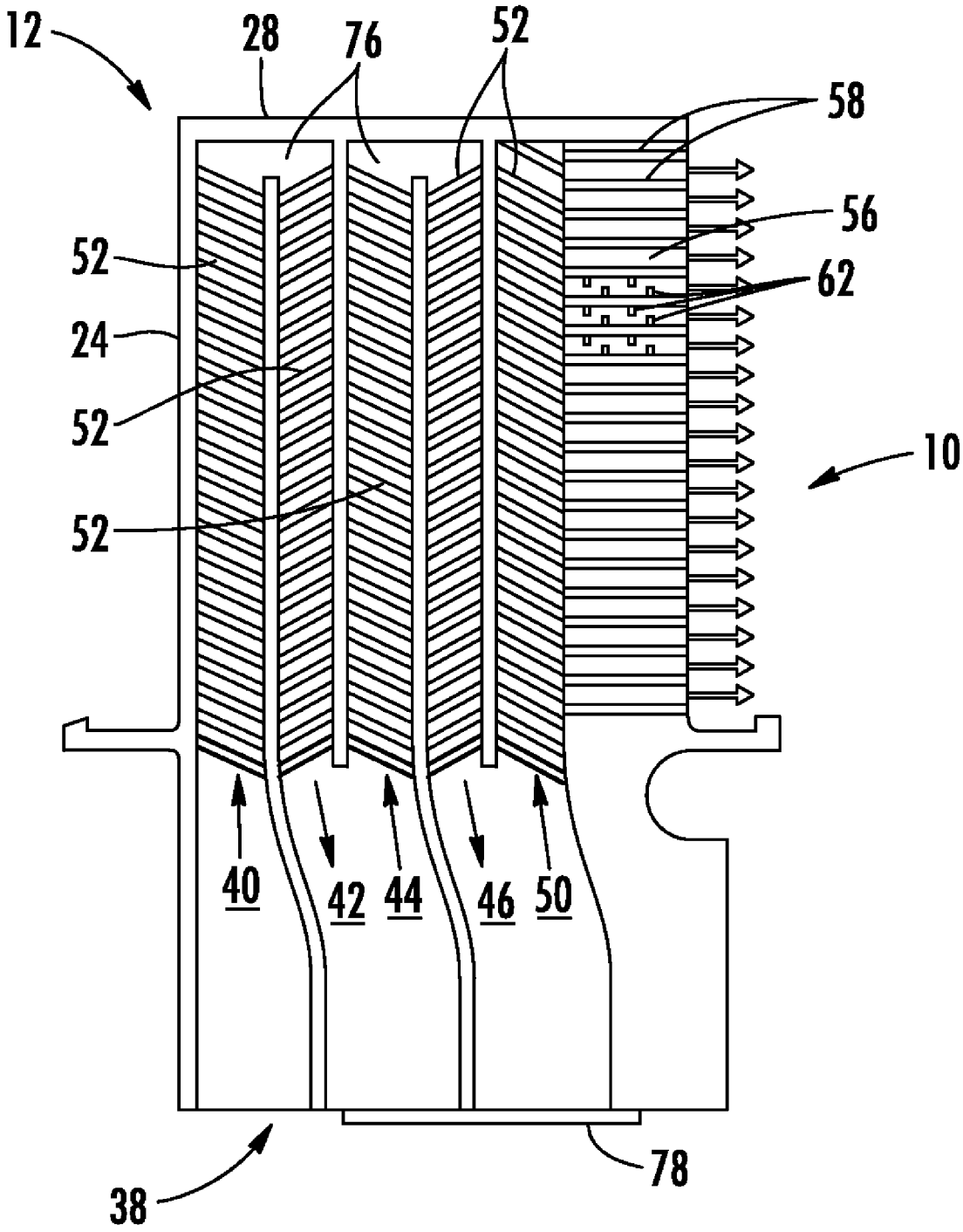
FIG. 5 is a sectional span wise elevation view of the turbine airfoil shown in FIG. 1 taken along line 5-5, showing an exemplary multi-pass serpentine cooling circuit with a micro channel discharge at the trailing edge region.

According an aspect of the invention, an aft flowing 5-pass serpentine cooling design is used for the entire blade as a single cooling flow circuitry (see FIG. 5). The cooling air flows aft-ward and discharges at the airfoil trailing edge region. Showerhead cooling of the leading edge 24 through cooling holes 54 from the forward channel 40 can be utilized. In blades having low cooling flow consumption and small leading edge impingement hole size, backside impingement for the airfoil leading edge region is not implemented.

The trailing edge cooling system provides an improved overall cooling performance that increases internal convective efficiency through the use of micro channels 56 with turbulator enhanced extended surfaces. These micro channels 56 are constructed with multiple thin, extended surfaces or fins 58 which are built-in along the full length of the blade trailing edge region 60 from the rearward pass 50 to the trailing edge 26 and across from pressure side wall 34 to suction side wall 36. Pressure side bleed cooling slots 60 can also be incorporated with the multiple micro cooling channels 56.

The micro channels 56 are formed by the span wise stacking of the fins 58 that are spaced apart to provide the intervening micro channels 58. The fins 58 extend chord wise from the rearward pass 50 of the serpentine circuit 38 to the pressure side bleed opening 60 just forward of the tip of the trailing edge 26.

Figure 4:
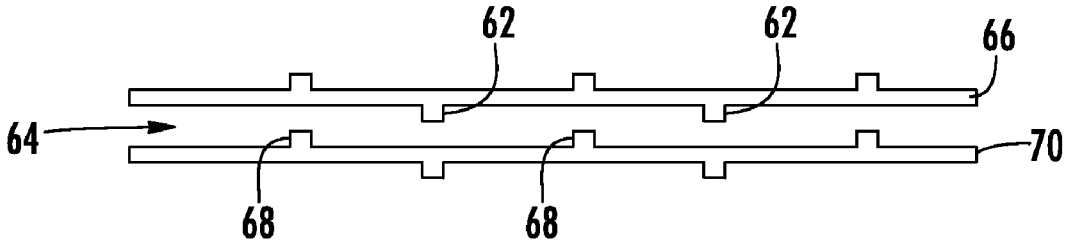
FIG. 4 is a sectional view of a fin-micro channel stack taken at line 4-4 in FIG. 3.

Some or all of the fins 58 can include trip strips or turbulators 62 that extend into the micro channels 56 and serve to trip the cooling flow and increase the effectiveness of the heat transfer. The fins 58 can provide two or more trip strips 62. As shown in FIG. 4, in one embodiment, a set of trip strips 62 extending into a micro channel 64 from one fin 66 can be staggered relative to a set of trip strips 68 extending into the same micro channel 64 from an adjacent fin 70.

The fins 58 and the micro channels 56 are relatively thin. The height of the micro channels 56 can be approximately two times the thickness of the fins 58. A typical thickness for the chord wise fin 58 can be in the range of 0.005 inches to 0.03 inches. Heights of the turbulators 62 can be in the range of 0.005 inches to 0.01 inches. At the pressure side lip 72, the thickness of the pressure side wall 34 can be in the range of 0.005 inches to 0.03 inches. The diameter of the airfoil suction side trailing edge corner 74 can be in the range of 0.02 to 0.05 inches.

Referring to the figures and particularly, FIG. 5, which presents a pull plane view of the 5-pass cooling system 10 along the centerline of the airfoil 12, cooling flow circuitry 38 is also presented on the figure. The total blade cooling air is fed through the blade leading edge channel 40 and then flows aft toward trailing edge. Cooling air is bled off from the first, forward leg 50 and discharged through the leading edge showerhead film cooling holes to form a film cooling layer for the cooling of blade leading edge 24 where the heat load is the highest on the entire airfoil 12. A majority of the total cooling air is then serpentine routed through the airfoil 12 to provide blade mid-chord section cooling. A portion of the cooling air is also bled off from the tip turns 76 on the pressure side of the airfoil for the cooling of blade pressure side edge. The 5-pass circuit 38 can be arranged as a single circuit, with root inlets limited to the first pass 40 by a cover plate 78 at the root end 30 of the remaining channels 42, 44, 46, 50. Cooling air is then finally discharged through the trailing edge micro cooling channels 56.

Cooling air is fed from the rearward, fifth serpentine flow passage 50 and then discharged rearward through the series of chord wise slots formed by the micro channels 56. The trip strips 62 in a staggered array are built onto the chord wise extended surfaces 58 to augment the cooling flow turbulence level. Only representative channels 56 and extended surfaces 58 are referenced in the drawings for clarity of illustration, it being understood that the similarly depicted channels and fins not referenced can be of the same size, shape and construction. Similarly, for clear illustration, only a few representative trip strips 62 are shown and referenced, while it is to be understood that some or all of the remaining fins can provide similar trip strips extending into the micro channels. Due to the wall to wall fin construction, a highly effective internal convective area ratio to external hot gas side are can be achieved. After passing through the multiple thin slots 56, cooling air is finally exit through the pressure side wall 34 of the airfoil 20, forward of the trailing edge corner 72.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil formed by an outer wall extending chord wise from a forward leading edge to a rearward trailing edge, a tip section at a first span wise end, a root coupled to the airfoil at an end generally opposite the first end span wise for supporting the airfoil and for coupling the airfoil to a disc, and a cooling system formed from at least one cavity in the elongated, hollow airfoil positioned in internal aspects of the generally elongated, hollow airfoil; said outer wall having a concave pressure side and a convex suction side separated rearwardly by the trailing edge;

said at least one cavity forming a multi-pass serpentine flow circuit with each pass extending span wise and connecting chord wise at a turn with an adjacent pass and providing a flow path from a forward cooling flow entry at the root and exhausting towards the trailing edge;

a series of chord wise micro channels extending from the rearward pass of the multi-pass serpentine circuit to pressure side bleed slots, each having a forward pressure side lip and opening onto the pressure side adjacent the trailing edge, said micro channels being formed by a series of spaced fins stacked span wise and extending between the outer wall on the pressure side and the outer wall on the suction side and extending chord wise from the rearward pass to the trailing edge; and at least two trip strips extending from sides of the fins into the micro channels, whereby turbulent flow levels in the micro channels are increased.

2. The turbine blade of claim 1, wherein a set of at least two trip strips extends from either side of each of the fins into the micro channels.

3. The turbine blade of claim 2, wherein each set of at least two trip strips extending into each of the micro channels is staggered relative an opposing set of at least two trip strips extending into the same micro channel from an adjacent fin.

4. The turbine blade of claim 1, wherein the span wise height of each micro channel is approximately two times the span wise thickness of each fin.

5. The turbine blade of claim 1, wherein a span wise thickness of each fin is in a range of 0.005 inches to 0.03 inches.

6. The turbine blade of claim 1, wherein a span wise height of each trip strip span is between 0.005 inches to 0.01 inches.

7. The turbine blade of claim 1, wherein an outer wall thickness at the pressure side lip is in the range of 0.005 inches to 0.03 inches.

8. The turbine blade of claim 1, wherein a diameter of the airfoil suction side trailing edge corner is in the range of 0.02 inches to 0.05 inches.

9. The turbine blade of claim 1, wherein the multi-pass serpentine flow circuit has five passes.

10. The turbine blade of claim 1, further comprising multiple leading edge showerhead film cooling holes extending from a forward pass of the multi-pass serpentine flow circuit to the leading edge for supplying cooling air to the leading edge.

11. The turbine blade of claim 1, further comprising tip bleed holes for supplying cooling air to the blade tip from the multi-pass serpentine flow circuit.

12. The turbine blade of claim 1, wherein the blade is TBC coated.

* * * * *